US011523673B2

(12) United States Patent
Lee

(10) Patent No.: US 11,523,673 B2
(45) Date of Patent: Dec. 13, 2022

(54) STICK-TYPE COSMETIC CONTAINER FOR CONTROLLING ROTATIONAL ANGLE OF ROTATING BODY AT PREDETERMINED ANGLE

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 335 days.

(21) Appl. No.: 16/765,053

(22) PCT Filed: Oct. 26, 2018

(86) PCT No.: PCT/KR2018/012854
§ 371 (c)(1),
(2) Date: May 18, 2020

(87) PCT Pub. No.: WO2019/103335
PCT Pub. Date: May 31, 2019

(65) Prior Publication Data

US 2021/0378384 A1 Dec. 9, 2021

(30) Foreign Application Priority Data

Nov. 27, 2017 (KR) ..... 10-2017-0159271

(51) Int. Cl.
*A45D 40/00* (2006.01)
*A45D 40/04* (2006.01)
*A45D 40/26* (2006.01)

(52) U.S. Cl.
CPC ..... *A45D 40/04* (2013.01); *A45D 40/26* (2013.01); *A45D 2040/0025* (2013.01)

(58) Field of Classification Search
CPC ..... A45D 40/00; A45D 40/02; A45D 40/04; A45D 40/10; A45D 40/20; A45D 40/26; A45D 2040/0025; A45D 2040/0062; B65D 83/0005; B65D 83/0011
USPC ..... 401/88, 74, 75
See application file for complete search history.

(56) References Cited

U.S. PATENT DOCUMENTS 5,000,356 A * 3/1991 Johnson ..... A45D 40/04 401/175
5,573,341 A * 11/1996 Iaia ..... A45D 40/04 401/175
5,725,133 A * 3/1998 Iaia ..... B65D 83/0011 401/175

FOREIGN PATENT DOCUMENTS

JP 2009045303 A 3/2009
KR 10-1557583 B1 10/2015
KR 10-1666012 B1 10/2016
(Continued)

*Primary Examiner* — David J Walczak
(74) *Attorney, Agent, or Firm* — Heedong Chae; Lucem, PC

(57) ABSTRACT

A stick-type cosmetic container for controlling the rotational angle of a rotating body at a predetermined angle, which allows stick cosmetics to be withdrawn from or inserted in a main body by the rotation of the rotating body, has a first rotational angle adjusting part formed at the lower part of the main body, and a second rotational angle adjusting member formed inside the rotating body so as to be elastically movable up and down, such that the first rotational angle adjusting part and the second rotational angle adjusting member engage with each other.

9 Claims, 11 Drawing Sheets

(56) References Cited

FOREIGN PATENT DOCUMENTS

| | | | |
|---|---|---|---|
| KR | 10-1782727 | B1 | 9/2017 |
| KR | 10-1782508 | B1 | 10/2017 |

* cited by examiner

--Prior Art--

STICK-TYPE COSMETIC CONTAINER FOR CONTROLLING ROTATIONAL ANGLE OF ROTATING BODY AT PREDETERMINED ANGLE

TECHNICAL FIELD

The present invention relates to a stick-type cosmetic container for controlling a rotational angle of a rotating body at a predetermined angle and, more specifically, to a stick-type cosmetic container for controlling a rotational angle of a rotating body at a predetermined angle, which allows stick cosmetics to be withdrawn from or inserted in a main body by the rotation of the rotating body, has a first rotational angle adjusting part formed at the lower part of the main body, and has a second rotational angle adjusting member formed inside the rotating body so as to be elastically movable up and down, such that the first rotational angle adjusting part and the second rotational angle adjusting member engage with each other, thereby allowing, when the rotating body rotates from the main body, the second rotational angle adjusting member of the rotating body to repeatedly engage with the first rotational angle adjusting part at a predetermined rotational angle while elastically moving up and down. Thus, the present invention can control the rotational angle of the rotating body at the predetermined angle all the time so as to have improved convenience of use.

BACKGROUND ART

In general, women use various cosmetics to make their appearance more beautiful. Among the cosmetics, color cosmetics are used for the purpose of beautifully changing the appearance and directing the skin.

Color cosmetics are classified into a base makeup used for making a skin color uniform and capping a defect and a point makeup used for partially enhancing a three-dimensional effect of a lip, eyes, or nails. The base makeup includes a makeup base, a foundation and a powder, and the point makeup includes a lipstick, an eye liner, and mascara.

The foundation is a cosmetic that is used to naturally cover skin blemishes, freckles, and the like which are exposed to an outside, such as a face, or to express clean and bright skin or clear and soft skin. When applying makeup using the foundation, the foundation is applied to the skin with a cosmetic puff and spread evenly without balling.

The foundation is generally stored in a wide and flat compact container, and a puff is kept inside the compact container.

However, in order to use the foundation contained in the compact container, the user opens the container lid, grabs the puff contained in an upper portion of the container lid, and then opens the container lid. Since the foundation cosmetics are stuck on the puff to be applied on the skin, the foundation cosmetics remaining in the puff in this process are smeared on the user's hands.

Accordingly, for convenience of use and convenience of carrying, a stick-type cosmetic container has been developed in which stick-type cosmetics are mounted on one side of the container, and the stick-type cosmetics mounted inside the container are moved up and down by rotating the container.

A conventional stick-type cosmetic container (Korean Registered Utility Model Publication No. 20-0393382 entitled 'Stick-type cosmetic container') having such a structure is as follows.

As shown in FIG. 1, the conventional stick-type cosmetic container includes a housing, a lower cap coupled to the lower portion of the housing and having a screw-type elevating guide hole, an operating member that moves up and down according to the rotation of the lower cap, a containing member to which stick-type cosmetics are attached and which moves up and down together with the operating member, a protective tube that supports up and down movements of the containing member and stores stick-shaped cosmetics, and an upper cap that seals the protective tube. Thus, the stick-type cosmetics appear and disappear from the protective tube as the housing is rotated while the protective tube is gripped.

However, according to the related art, when makeup is applied, the stick-type cosmetics may appear or disappear from the protection tube or be inserted into the protection tube while the housing is rotated due to carelessness of the user, so that the convenience of use is poor.

To solve the above problems, as shown in FIG. 2, a cosmetic tool is disclosed in Korean Registered Patent No. 10-1594253. According to the related art, when the snap ring 2 is formed inside the main body 1 and the rotating part 3 having an oval or polygonal cross section is rotated around the main body, the rotation of the rotating part 3 is limited at certain angles by the snap ring 2, so that it is possible to conveniently control the up and down movements of cosmetics.

Looking at the rotation limiting structure of the related art in detail, as shown in FIG. 3, the protrusion inlet 2-1 is formed on the snap ring 2, and the snap protrusion 3-1 is formed on the outer periphery of the rotating part 3. The rotation of the rotating part 3 is limited while the snap protrusion 3-1 of the rotating part 3 is forcibly passed through the inner circumferential surface of the snap ring 2 and inserted into the protrusion inlet 2-1 of the snap ring 2.

However, according to the related art, the rotating part 3 must be strongly rotated in order to force the snap protrusion 3-1 of the rotating part 3 to pass through the inner circumferential surface of the snap ring 2, so that women having the relatively weak force cannot easily rotate the rotating part 3, so it is inconvenient in use.

In addition, according to the related art, when used for a long period of time, the snap protrusion 3-1 of the rotating part 3 wears while causing friction with the inner circumferential surface of the snap ring 2, so that the rotation limit function of the rotating part 3 through the snap ring 2 cannot be performed.

DISCLOSURE

Technical Problem

To solve the problems described above, an object of the present invention is to provide a stick-type cosmetic container for controlling a rotational angle of a rotating body at a predetermined angle, which can allow stick cosmetics to be withdrawn from or inserted in a main body by the rotation of the rotating body, have a first rotational angle adjusting part formed at the lower part of the main body, and have a second rotational angle adjusting member fainted inside the rotating body so as to be elastically movable up and down, such that the first rotational angle adjusting part and the second rotational angle adjusting member engage with each other, thereby allowing, when the rotating body rotates from the main body, the second rotational angle adjusting member of the rotating body to repeatedly engage with the first rotational angle adjusting part at a predetermined rotational angle while elastically moving up and down. Thus, the stick-type cosmetic container can control the rotational angle of the rotating body at the predetermined angle all the time so as to have improved convenience of use.

In addition, another object of the present invention is to provide a stick-type cosmetic container for controlling a rotational angle of a rotating body at a predetermined angle, in which a first curved insertion portion and a first curved protrusion portion are formed in a first rotational angle adjusting part formed in a lower portion of a main body, a second curved insertion portion and a second curved protrusion portion are formed in the second rotational angle adjusting member formed inside a rotating body, and a first curved insertion portion and a first curved protrusion portion of the first rotational angle adjusting part correspond to a second curved insertion portion and a second curved protrusion portion of a second rotational angle adjusting member, respectively. When the rotating body is grasped and forcibly rotated with respect to the main body, the second curved protrusion portion of the second rotational angle adjusting member is released from the first curved insertion portion of the first rotational angle adjusting part, so that the second curved protrusion portion naturally passes over the first curved protrusion portion 146 and is elastically inserted into the first curved insertion portion again. Thus, the rotational texture of the rotating body is soft, so that the usability is improved.

Technical Solution

According to the present invention, there is provided a stick-type cosmetic container for controlling a rotational angle of a rotating body at a predetermined angle, which includes:

a main body formed at one side thereof with an inlet and at an opposite side thereof with a first rotational angle adjusting part;

a rotating body rotatably coupled to the main body;

an elevating plate moved up and down inside the main body, the lifting plate having one side to which stick cosmetics are attached and an opposite side at which a screw groove is formed;

an operating member coupled to an inside of the rotating body to rotate together with the rotating body, and formed with a screw protrusion coupled to the screw groove of the elevating plate;

a second rotational angle adjusting member movable up and down inside the rotating body to rotate together with the rotating body and engaged with the first rotational angle adjusting part; and an elastic member for elastically supporting the second rotational angle adjusting member, wherein, when the rotating body rotates, the second rotational angle adjusting member is repeatedly engaged at a predetermined rotational angle with the first rotational angle adjusting part while elastically moving up and down to constantly control a rotational angle of the rotating body at a predetermined angle.

The stick-type cosmetic container may further include an overcap that opens and closes the main body.

The compact cosmetic container may further include a lower cap coupled to the rotating body.

A rotating body through hole may be formed at a center of the rotating body such that the first rotational angle adjusting part of the main body is rotatably coupled while passing through the rotating body through hole.

A rotating body through hole may be formed at a center of a lower portion of the main body, and a central cylinder is formed at a center of the operating member such that the central cylinder is rotatably coupled while passing through the main body through hole from an inside of the rotating body.

A vertical insertion groove may be formed in the rotating body, and a vertical insertion piece is formed in the second rotational angle adjusting member and inserted into the vertical insertion groove.

A vertical guide groove may be formed in the second rotational angle adjusting member, and a vertical guide bar is formed in the operating member and inserted into the vertical guide groove.

A first curved insertion portion and a first curved protrusion portion may be formed in the first rotational angle adjusting part, a second curved insertion portion and a second curved protrusion portion may be formed in the second rotational angle adjusting member, and the first curved insertion portion and the first curved protrusion portion of the first rotational angle adjusting part correspond to the second curved insertion portion and the second curved protrusion portion of the second rotational angle adjusting member, respectively.

The second curved insertion portion and the second curved protrusion portion may be formed in a stepped shape inside the second rotational angle adjusting member, such that lower ends of the first curved insertion portion and the first curved protrusion portion of the first rotational angle adjusting part are placed thereon.

Advantageous Effects

According to the present invention, a stick-type cosmetic container for controlling a rotational angle of a rotating body at a predetermined angle can allow stick cosmetics to be withdrawn from or inserted in a main body by the rotation of the rotating body, have a first rotational angle adjusting part formed at the lower part of the main body, and have a second rotational angle adjusting member formed inside the rotating body so as to be elastically movable up and down, such that the first rotational angle adjusting part and the second rotational angle adjusting member engage with each other, thereby allowing, when the rotating body rotates from the main body, the second rotational angle adjusting member of the rotating body to repeatedly engage with the first rotational angle adjusting part at a predetermined rotational angle while elastically moving up and down. Thus, the stick-type cosmetic container can control the rotational angle of the rotating body at the predetermined angle all the time so as to have improved convenience of use.

In addition, according to the present invention, there is provided a stick-type cosmetic container for controlling a rotational angle of a rotating body at a predetermined angle, in which a first curved insertion portion and a first curved protrusion portion are formed in a first rotational angle adjusting part formed in a lower portion of a main body, a second curved insertion portion and a second curved protrusion portion are formed in the second rotational angle adjusting member faulted inside a rotating body, and a first curved insertion portion and a first curved protrusion portion of the first rotational angle adjusting part correspond to a second curved insertion portion and a second curved protrusion portion of a second rotational angle adjusting member, respectively. When the rotating body is grasped and forcibly rotated with respect to the main body, the second curved protrusion portion of the second rotational angle adjusting member is released from the first curved insertion portion of the first rotational angle adjusting part, so that the second curved protrusion portion naturally passes over the first curved protrusion portion 146 and is elastically inserted into the first curved insertion portion again. Thus, the rotational texture of the rotating body is soft, so that the usability is improved.

BEST MODE

Mode for Invention

Technical objects to be achieved by the present invention and embodiments of the present invention will be apparent through preferable embodiments to be described below. Hereinafter, a stick-type cosmetic container for controlling a rotational angle of a rotating body at a predetermined angle according to the present invention will be described with reference to accompanying drawings.

Figure 1:
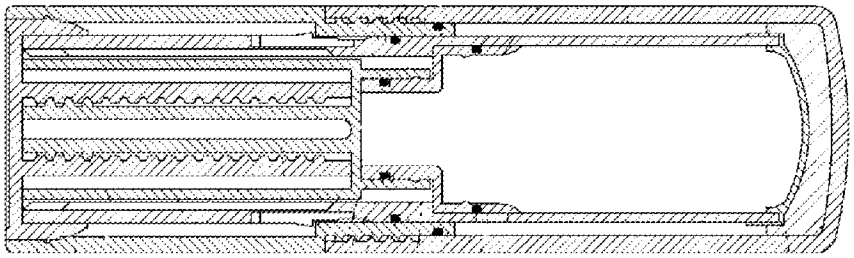
FIG. 1 is a view illustrating a stick-type cosmetic container according to the related art.
Figure 2:
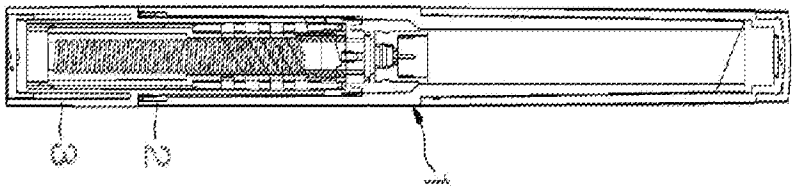
FIG. 2 is a view illustrating a cosmetic tool according to the related art.
Figure 3:
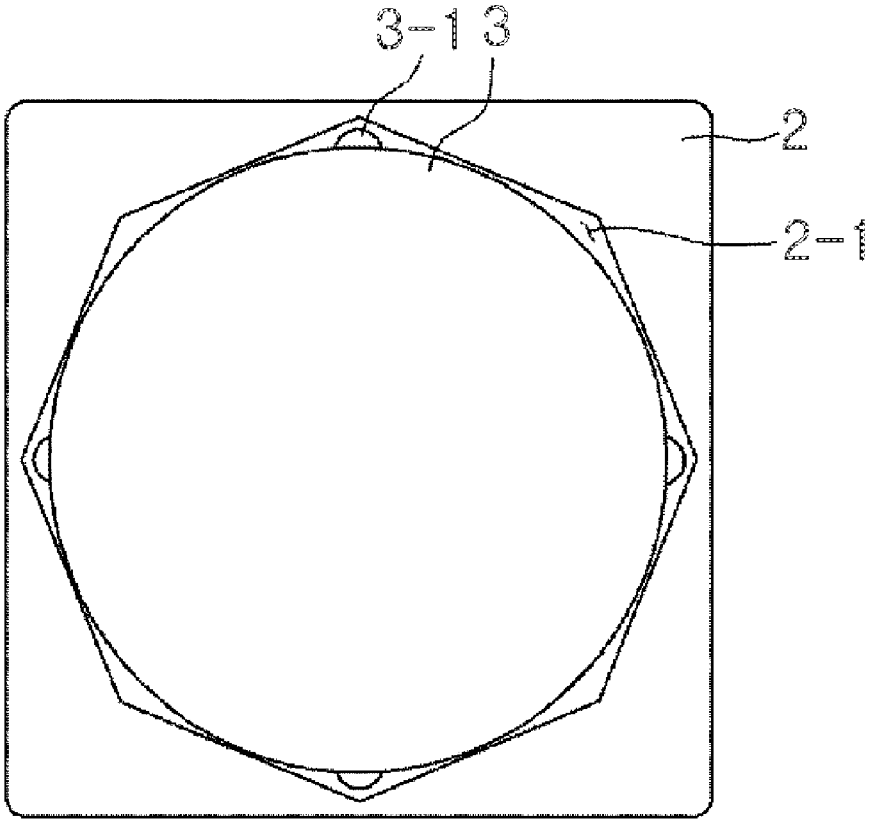
FIG. 3 is a view illustrating a rotational restriction structure of a rotating part installed in a cosmetic tool according to the related art.
Figure 4:
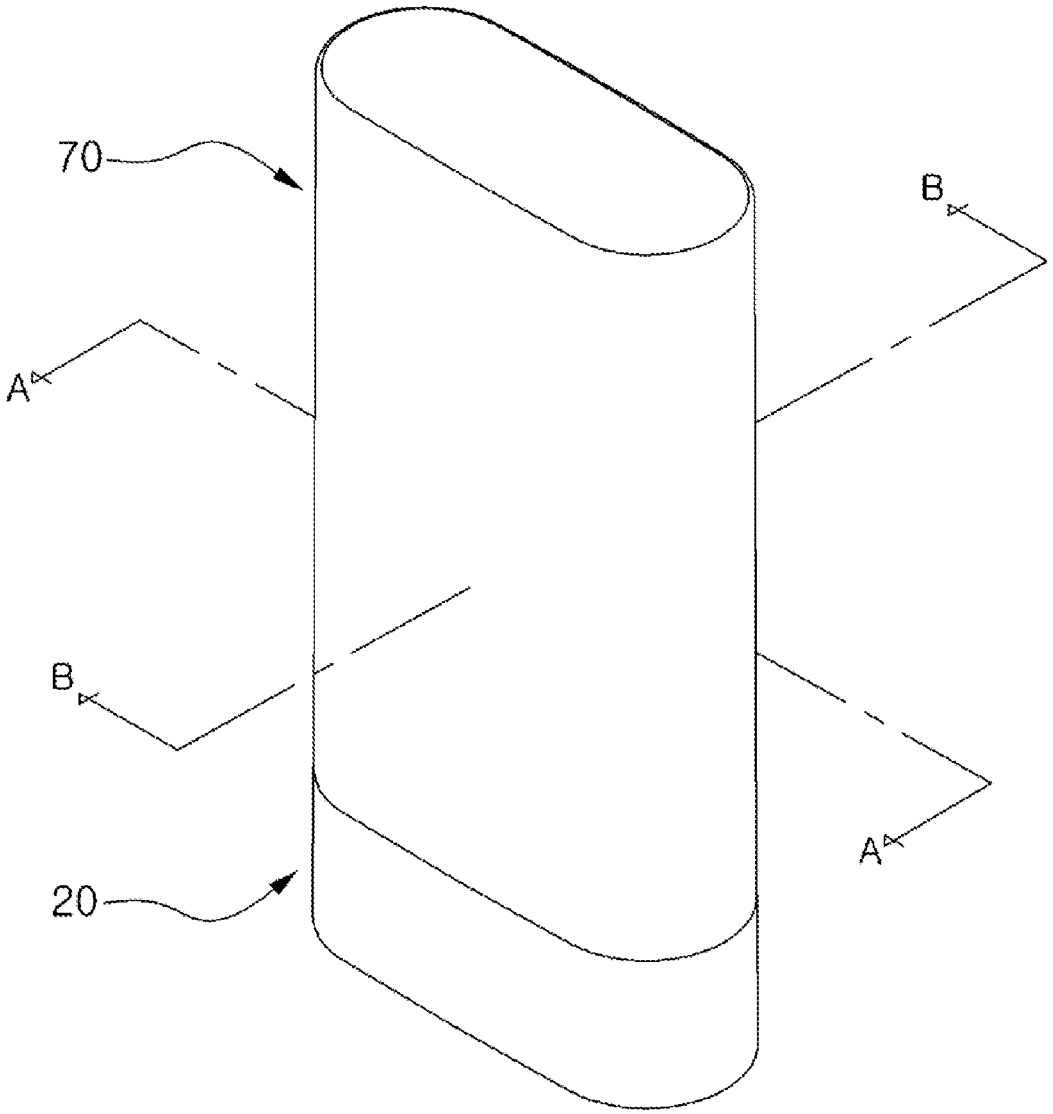
FIG. 4 is a perspective view of a stick-type cosmetic container according to the present invention.
Figure 5:
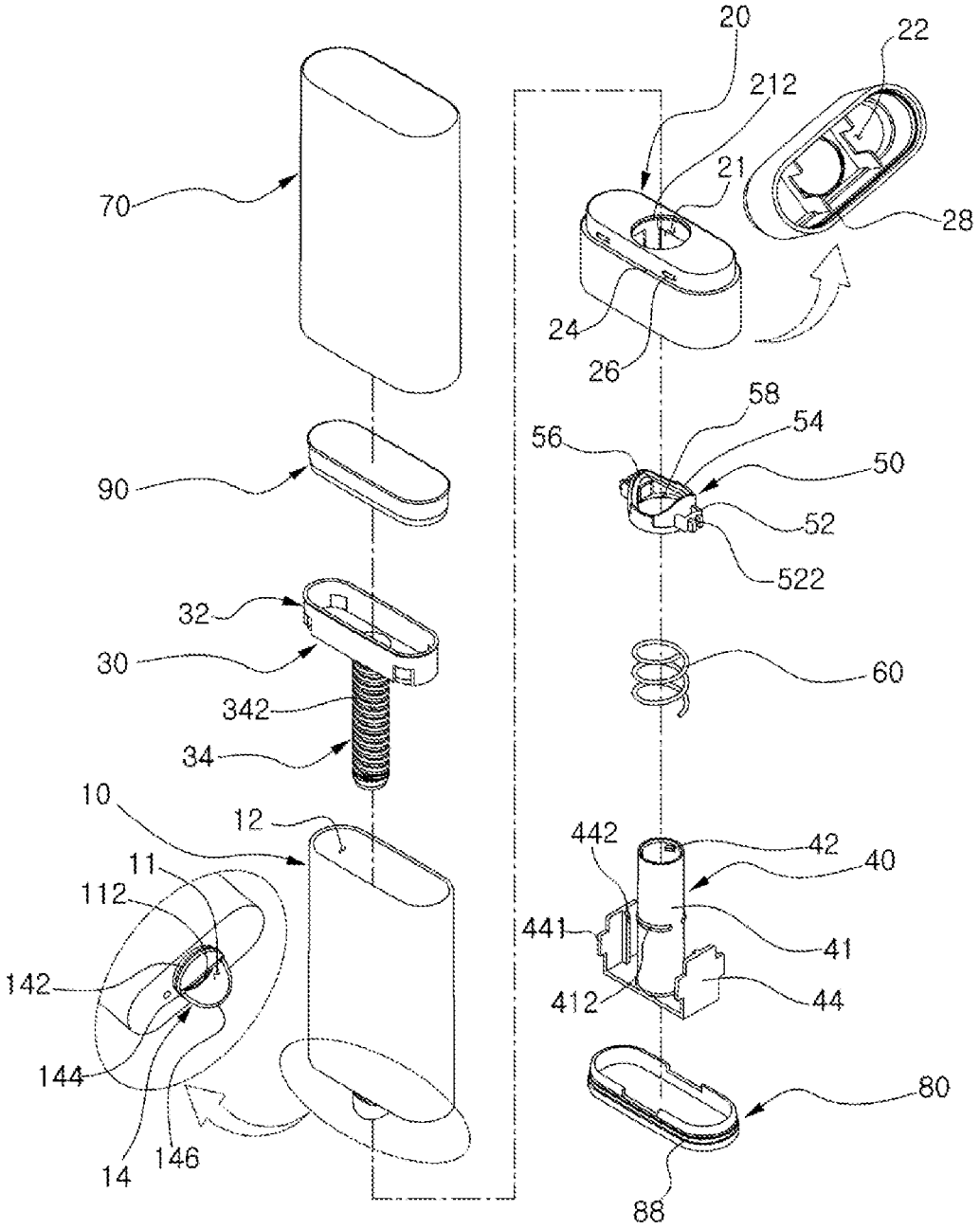
FIG. 5 is an exploded perspective view of a stick-type cosmetic container according to the present invention.
Figure 6:
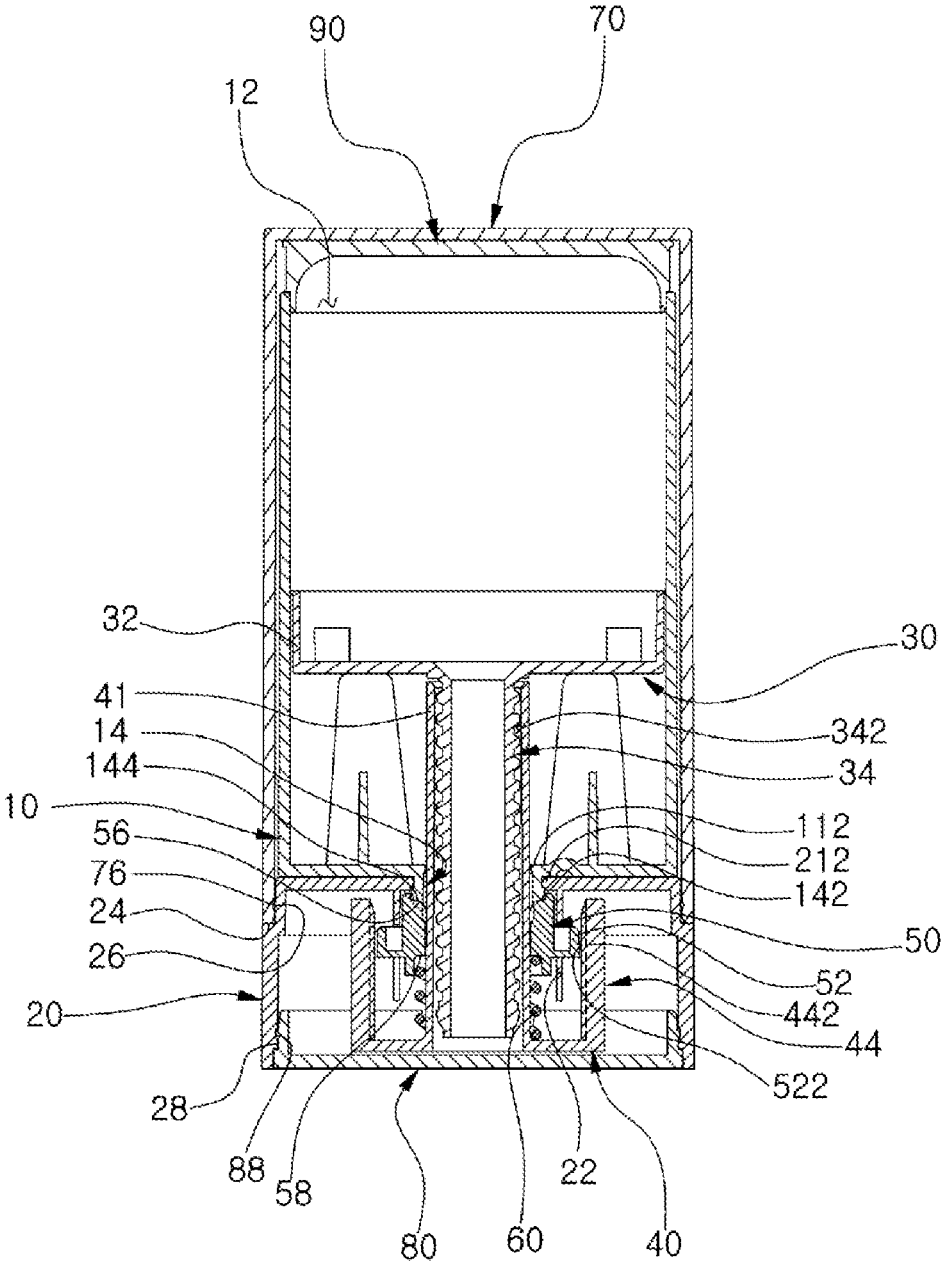
FIG. 6 is a cross-sectional view of a stick-type cosmetic container according to the present invention, which is taken along line A-A.
Figure 7:
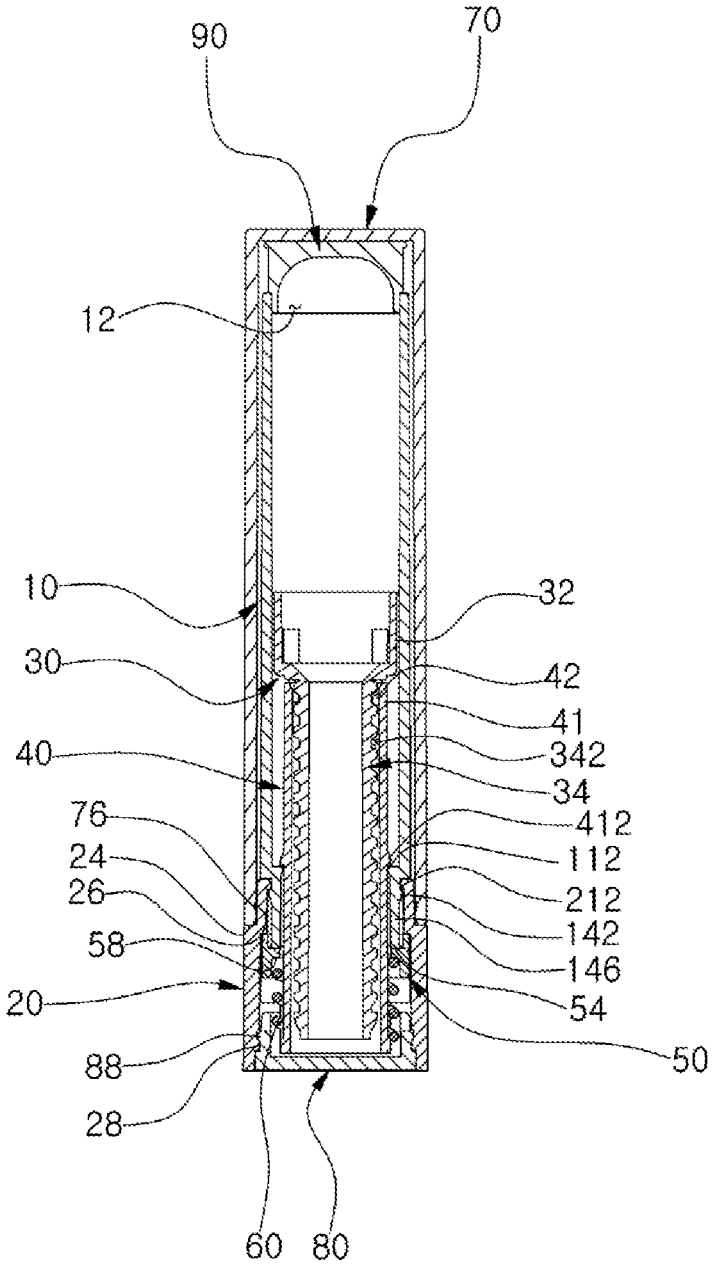
FIG. 7 is a cross-sectional view of a stick-type cosmetic container according to the present invention, which is taken along line B-B.

FIG. 4 is a perspective view of a stick-type cosmetic container according to the present invention. FIG. 5 is an exploded perspective view of a stick-type cosmetic container according to the present invention. FIG. 6 is a cross-sectional view of a stick-type cosmetic container according to the present invention, which is taken along line A-A. FIG. 7 is a cross-sectional view of a stick-type cosmetic container according to the present invention, which is taken along line B-B.

A stick-type cosmetic container for controlling a rotational angle of a rotating body according to the present invention includes a main body 10 formed at one side thereof with an inlet 12 and at an opposite side thereof with a first rotational angle adjusting part 14; a rotating body 20 rotatably coupled to the main body 10; an elevating plate 30 moved up and down inside the main body 10 and having one side to which stick cosmetics 'S' are attached and an opposite side at which a screw groove 342 is formed; an operating member 40 coupled to an inside of the rotating body 20 to rotate together with the rotating body 20 and formed with a screw protrusion 42 coupled to the screw groove 342 of the elevating plate 30; a second rotational angle adjusting member 50 movable up and down inside the rotating body 20 to rotate together with the rotating body 20 and engaged with the first rotational angle adjusting part 14; and an elastic member 60 for elastically supporting the second rotational angle adjusting member 50, where, when the rotating body 20 rotates, the second rotational angle adjusting member 50 is repeatedly engaged at a predetermined rotational angle with the first rotational angle adjusting part 14 while elastically moving up and down to constantly control a rotational angle of the rotating body 20 at a predetermined angle.

The inlet 12 is formed on an upper portion of the main body 10 such that the stick cosmetics 'S' attached to the elevating plate 30 through the inlet 12 is withdrawn to an outside or inserted into the main body 10.

As shown in FIG. 5, the main body through hole 11 is formed at the center of a lower portion of the main body 10, and a first coupling protrusion wheel 112, which is formed outside the main body through hole 11, is rotatably coupled to the operating member 40.

A first rotational angle adjusting part 14 is formed outside the main body through hole 11. As shown in the embodiment of the present invention, the first rotational angle adjustment part 14 may be formed integrally with the main body 10, or may be formed separately and fixedly coupled to the main body 10.

A second coupling protrusion wheel 142 is formed on an outer periphery of the first rotational angle adjusting part 14 and is rotatably coupled to the rotating body 20.

A first curved insertion portion 144 and a first curved protrusion portion 146 are formed in the first rotational angle adjusting part 14. As shown in the enlarged portion of FIG. 5, the first curved insertion portion 144 has a curved shape concaved upward, and the first curved protrusion portion 146 is a curved shape protruding downward. The first curved insertion portion 144 and the first curved protrusion portion 146 are alternately connected to each other.

The main body 10 and the rotating body 20 are preferably formed in an elliptical or polygonal shape when viewed from the top so that the elevating plate 30, which will be described later, does not spin from the main body 10 with no traction.

The rotating body 20 is rotatably coupled to the lower portion of the main body 10.

As shown in FIG. 5, a rotating body through hole 21 is formed at the center of the upper surface of the rotating body 20, and a third coupling protrusion wheel 212 is formed outside the rotating body through hole 21. The second coupling protrusion wheel 142 and the third coupling protrusion wheel 212 of the main body 10 are rotatably undercut-coupled to each other while the first rotational angle adjusting part 14 of the main body 10 passes through the rotating body through hole 21.

As shown in the enlarged portion of FIG. 5, a pair of vertical insertion grooves 22 is formed inside the rotating body 20, and a first coupling protrusion 28 is formed on a lower inner peripheral surface.

A coupling step 24 is formed on an upper portion of the rotating body 20, and a coupling protrusion 26 is formed on an upper portion of the coupling step 24 to be coupled to an overcap 70.

The overcap 70 for opening and closing the main body 10 is further formed on an upper portion of the rotating body 20. A coupling groove 76 is formed on a lower inner periphery of the overcap 70 and coupled to the coupling protrusion 26 of the rotating body 20. When the rotating body 20 and the overcap 70 are coupled, a lower end of the overcap 70 is placed on the coupling step 24 of the rotating body 20.

As shown in FIG. 6, a sealing member 90 is further formed inside the overcap 70 to block the inlet 12 while being placed on the inlet 12.

A lower cap 80 is further coupled to a lower portion of the rotating body 20 to block the lower portion of the rotating body 20. The lower cap 80 is coupled to the lower side of the rotating body 20. A second coupling protrusion 88 is formed on an outer peripheral surface of the lower cap 80 to be coupled to the first coupling protrusion 28 of the rotating body 20.

As shown in FIG. 5, the elevating plate 30 is formed to be movable up and down in the main body 10.

The elevating plate 30 includes a plate portion 32 and a screw coupling portion 34 extending downwardly of the plate portion 30.

The stick cosmetics 'S' are attached to the plate portion 32 so that the stick cosmetics S are drawn out or drawn in from the main body 10 by vertical movement of the plate portion 32.

A screw groove 342 is formed on the outer periphery of the screw coupling portion 34. As shown in FIG. 7, as the screw coupling portion 34 is inserted into a central cylinder 41 of the operating member 40, the screw groove 342 formed on the outer periphery of the screw coupling portion 34 and a screw protrusion 42 formed on an inner periphery of the central cylinder 41 are coupled to each other.

The operating member 40 is coupled to the inside of the rotating body 20 to be rotated with the rotating body 20.

As shown in FIG. 5, the central cylinder 41 extending upwardly of the central cylinder 41 is formed at the center of the operating member 40, and a pair of side plates 44 extend upwardly and outwardly of the central cylinder 41.

As shown in FIG. 6, the central cylinder 41 of the operating member 40 is rotatably coupled while passing through the body through hole 11 of the main body 10. A fourth coupling protrusion wheel 412 is formed on an outer periphery of the central cylinder 41 and rotatably undercut-coupled to the first coupling protrusion wheel 112 of the main body 10.

As shown in FIG. 7, a screw protrusion 42 is formed on an inner periphery of the central cylinder 41 of the operating member 40, and the screw protrusion 42 is screw-coupled to a screw groove 342 of the elevating plate 30.

As shown in FIG. 5, protrusions 441 are formed on both side surfaces of the side plate 44 of the operating member 40 to be tightly closed to an inner peripheral surface of the rotating body 20, and vertical guide bars 442 are formed on an inner peripheral surface of the side plate 44 to guide the up and down movement of the second rotational angle adjusting member 50.

The second rotational angle adjusting member 50 is formed to be movable up and down inside the rotating body 20.

As shown in FIG. 5, a pair of vertical insertion pieces 52 are formed on an outer periphery of the second rotational angle adjusting member 50, where the vertical insertion pieces 52 are inserted into the vertical insertion grooves 22 of the rotating body 20 such that the second rotational angle adjusting member 50 is prevented from being deviated from the position thereof.

A vertical guide groove 522 is formed on an outer peripheral surface of the vertical insertion piece 52 of the second rotational angle adjusting member 50. As shown in FIG. 6, the vertical guide bar 442 of the operating member 40 is inserted into the vertical guide groove 522 to guide the up and down movement of the second rotational angle adjusting member 50.

As shown in FIG. 5, a second curved insertion portion 54 and a second curved protrusion portion 56 corresponding to the first curved protrusion portion 146 and the first curved insertion portion 144 of the first rotational angle adjusting part 14 are formed on an upper portion of the second rotational angle adjusting member 50. That is, the first curved protrusion portion 146 of the first rotational angle adjusting unit 14 is inserted into the second curved insertion portion 54 of the second rotational angle adjusting member 50, and the second curved protrusion portion 56 of the second rotational angle adjusting member 50 is inserted into the first curved insertion portion 144 of the first rotational angle adjusting part 14.

Like the first curved insertion portion 144 and the first curved protrusion portion 146 of the first rotational angle adjusting part 14, the second curved insertion portion 54 of the second rotational angle adjusting member 50 has a curved shape concaved downwardly, and the second curved protrusion portion 56 has a curved shape protruding upward, such that the second curved insertion portion 54 and the second curved protrusion portion 56 are alternately connected to each other.

The second curved insertion portion 54 and the second curved protrusion portion 56 are formed in a stepped shape inside an upper portion of the second rotational angle adjusting member 50, such that lower ends of the first curved insertion portion 144 and the first curved protrusion portion 146 of the first rotational angle adjusting part 14 are placed thereon. Therefore, the first curved insertion portion 144 and the first curved protrusion portion 146 of the first rotational angle adjusting part 14 are stably engaged with the second curved insertion portion 54 and the second curved protrusion portion 56 of the second curved angle adjusting member 50.

An elastic member insertion step 58 is formed on a lower inner periphery of the second rotational angle adjusting member 50.

The elastic member 60 is positioned below the second rotational angle adjusting member 50 to elastically support the second rotational angle adjusting member 50.

As shown in FIGS. 6 and 7, the elastic member 60 is positioned while surrounding the central cylinder 41 of the operating member 40, where one side of the elastic member 60 is tightly closed to a bottom surface of the operating member 40, and an opposite side is inserted into and tightly closed to the elastic member insertion step 58 of the second rotational angle adjusting member 50.

As described above, according to the stick-type cosmetic container of the present invention, when the rotating body 20 is rotated with respect to the main body 10, the second rotational angle adjusting member 50 is repeatedly engaged the first rotational angle adjusting part 14 at a predetermined rotational angle while being elastically moved up and down by the elastic member 60, such that the rotational angle of the rotating body 20 may be always controlled at the predetermined constant angle, so the structure thereof is improved.

Furthermore, according to the stick-type cosmetic container of the present invention, the first curved insertion portion 144, the first curved protrusion portion 146, the second curved insertion portion 54 and the second curved protrusion portion 56 are formed on the first rotational angle adjusting part 14 and the second rotational angle adjusting member 50 to correspond to each other, respectively. When the user grasps the rotating body 20 and forcibly rotates the rotating body 20 with respect to the main body 10, the second curved protrusion portion 56 of the second rotational angle adjusting member 50 is released from the first curved insertion portion 144 of the first rotational angle adjusting part 14, so that the second curved protrusion portion. 56 naturally passes over the first curved protrusion portion 146 and is elastically inserted into the first curved insertion portion 144 again. Thus, the rotational texture of the rotating body 20 is soft, so that the usability is improved. In addition, the second rotation angle adjusting member 50 is repeatedly engaged with the first rotational angle adjusting part 14 at the predetermined rotational angle while being elastically moved up and down by the elastic member 60, so that the portion for controlling the rotation angle is prevented from being worn, so even if used for a long period of time, the stick-type cosmetic container works smoothly.

A method of assembling the stick-type cosmetic container for controlling a rotational angle of a rotating body at a predetermined angle according to an embodiment of the present invention will be described with reference to the accompanying drawings as follows.

In order to assemble the stick-type cosmetic container that controls the rotational angle of the rotating body at a predetermined angle according to an embodiment of the present invention, first, as shown in FIGS. 5 and 6, the rotating body 20 is rotatably coupled to a lower portion of the body 10. The second coupling protrusion wheel 142 of the main body 10 is undercut-coupled to the third coupling protrusion wheel 212 of the rotating body 20 while the first rotational angle adjusting part 14 of the main body 10 passes through the rotating body through hole 21 of the rotating body 20.

Next, after fitting the outside of the central cylinder 41 of the operating member 40 with the elastic member 60, the second rotational angle adjusting member 50 is inserted. While the vertical guide bar 442 of the operating member 40 is fitted into the vertical guide groove 522 of the second rotational angle adjusting member 50, the upper end of the elastic member 60 is inserted into the elastic member insertion step 59 of the second rotational angle adjusting member 50.

Next, the central cylinder 41 of the operating member 40 passes through the body through hole 11 of the main body 10 while inserting the operating member 40 into the lower side of the rotating body 20, and is rotatably coupled. While the vertical insertion piece 52 of the second rotational angle adjusting member 50 is inserted into the vertical insertion groove 22 of the rotating body 20, the first coupling protrusion wheel 112 of the main body 10 and the fourth engaging protrusion 412 of the central cylinder 41 are undercut coupled.

In this case, the first curved insertion portion 144 of the first rotational angle adjusting part 14 is in close contact with the second curved protrusion portion 56 of the second rotational angle adjusting member 50, and the first curved protrusion 146 of the first rotational angle adjusting part 14 is in close contact with the second curved insertion portion 54 of the second rotational angle adjusting member 50.

Next, the lower cap 80 is coupled to the lower side of the rotating body 20 to block the lower portion of the rotating body 20.

Next, after inserting the elevating plate 30 into the inlet 12 of the main body 10, by rotating the rotating body 20 with respect to the main body 10, the screw protrusion 42 formed on the inner periphery of the central cylinder 41 of the operating member 40 is screw-coupled to the screw groove 342 formed on the outer periphery of the screw coupling portion 34 of the elevating plate 30.

In this case, the stick cosmetics 'S' is attached to the plate portion 32 of the elevating plate 30.

Next, the sealing member 90 is placed on the inlet 12 of the main body 10 to seal the main body 10.

Last, while the overcap 70 covers the upper portion of the main body 10, the overcap 70 and the rotating body 20 are coupled to each other, so that the assembly of the stick-type cosmetic container for controlling a rotational angle of a rotating body at a rotational angle according to an embodiment of the present invention is completed.

A method of using the stick-type cosmetic container for controlling a rotational angle of a rotating body at a rotational angle according to an embodiment of the present invention, which is assembled as described above, will be described with reference to the drawings as follows.

Figure 8:
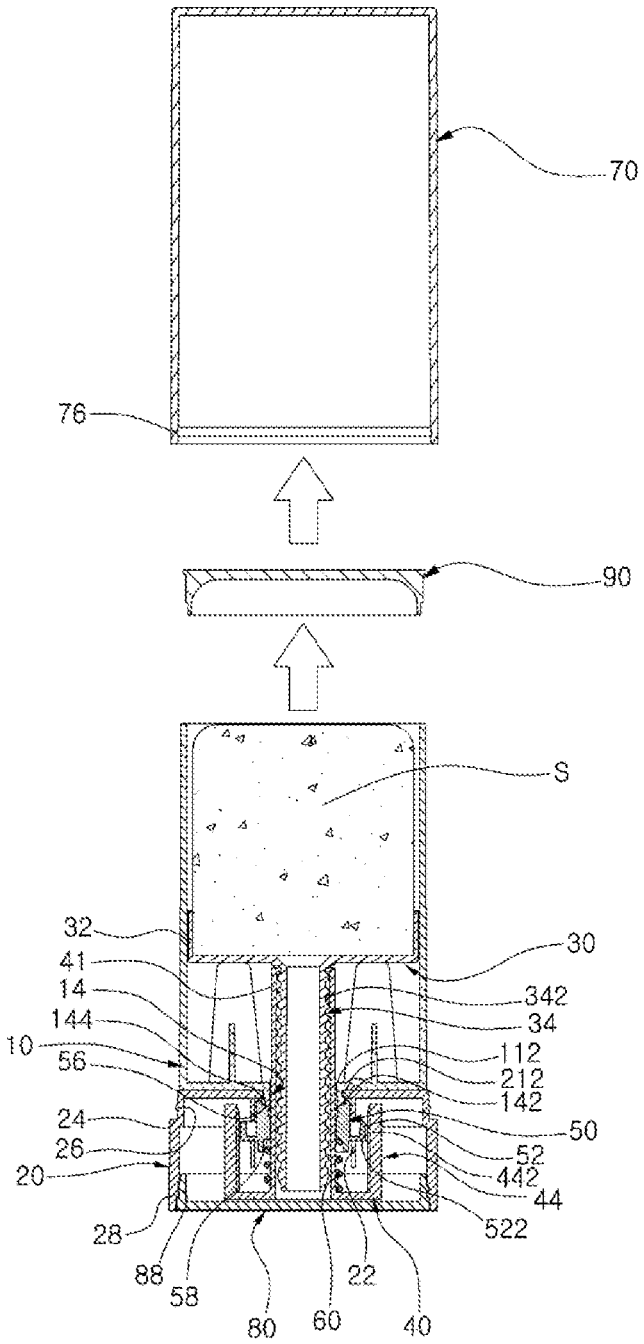
FIG. 8 is a cross-sectional view taken line A-A which illustrates a state in which the overcap and the sealing member of the stick-type cosmetic container according to the present invention are separated from each other.
Figure 9:
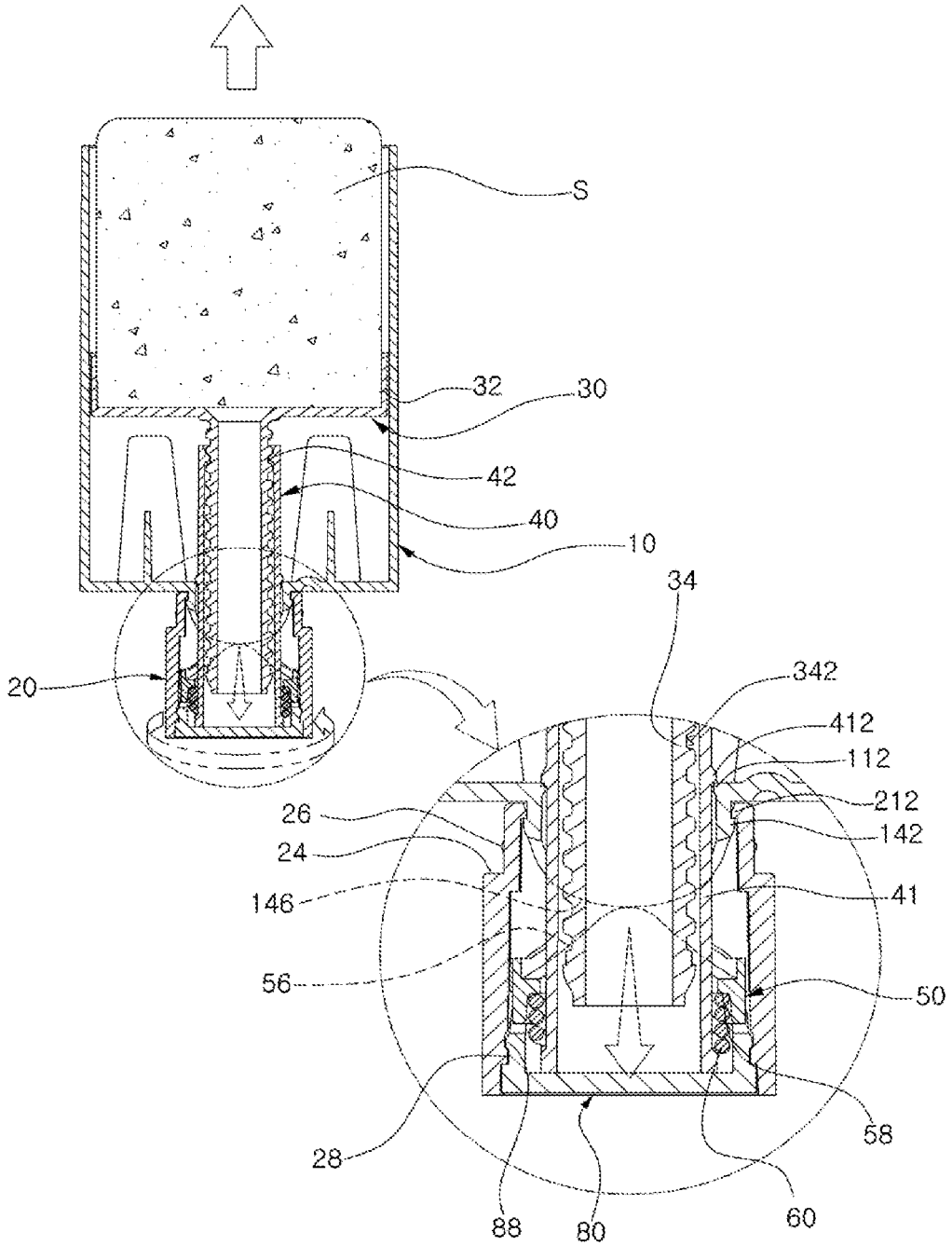
FIG. 9 is a cross-sectional view taken line A-A which illustrates a state in which the rotating body is rotated with respect to the main body of the stick-type cosmetic container according to the present invention.
Figure 10:
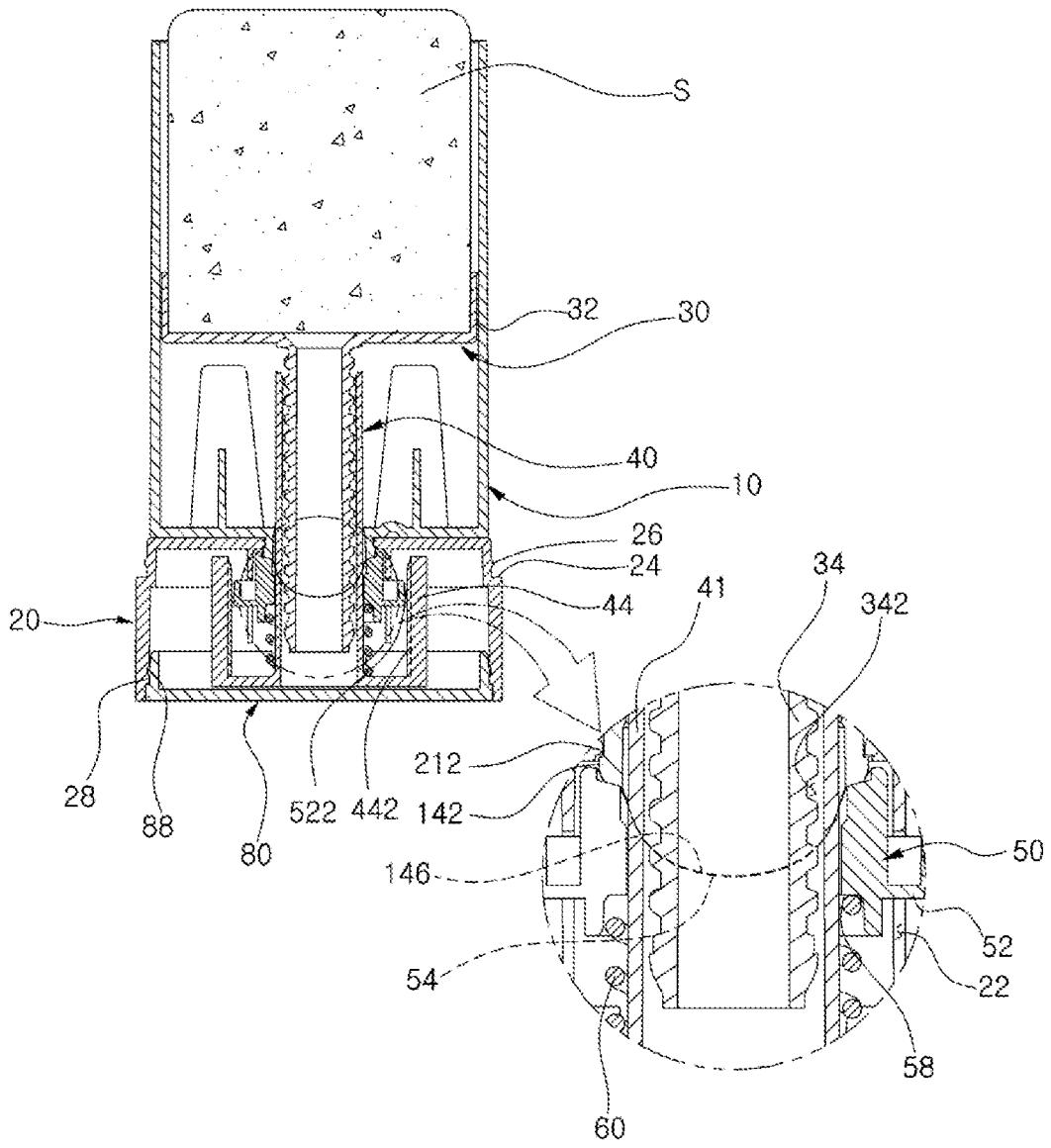
FIG. 10 is a cross-sectional view taken line A-A which illustrates a state in which the rotating body is rotated 180 degrees with respect to the main body of the stick-type cosmetic container according to the present invention.
Figure 11:
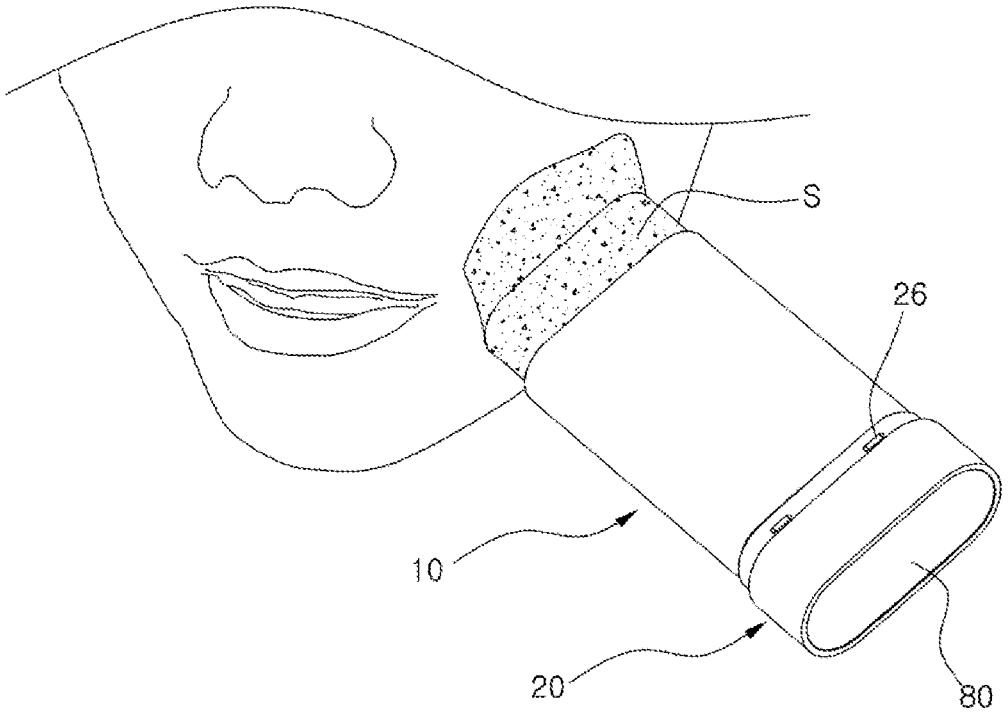
FIG. 11 is a perspective view illustrating a state in which makeup is performed using stick cosmetics drawn out from the main body of the stick-type cosmetic container according to the present invention.

FIG. 8 is a cross-sectional view taken line A-A which illustrates a state in which the overcap and the sealing member of the stick-type cosmetic container according to the present invention are separated from each other. FIG. 9 is a cross-sectional view taken line A-A which illustrates a state in which the rotating body is rotated with respect to the main body of the stick-type cosmetic container according to the present invention. FIG. 10 is a cross-sectional view taken line A-A which illustrates a state in which the rotating body is rotated 180 degrees with respect to the main body of the stick-type cosmetic container according to the present invention. FIG. 11 is a perspective view illustrating a state in which makeup is performed using stick cosmetics drawn out from the main body of the stick-type cosmetic container according to the present invention.

In order to use the stick-type cosmetic container for controlling a rotational angle of a rotating body at a predetermined angle according to an embodiment of the present invention, first, as shown in FIG. 8, the overcap 70 and the sealing member 90 are sequentially separated from the main body 10 to open the inlet 12 of the main body 10.

Thereafter, as shown in FIG. 9, the rotating body 20 is rotated in one direction with respect to the main body 10. In this case, the protrusion portion 441 of the operating member 40 is in close contact with the inner peripheral surface of the rotating body 20, and the vertical insertion piece 52 of the second rotational angle adjusting member 50 is inserted into the vertical insertion groove 22 of the rotating body 20, so that the operating member 40 and the second rotational angle adjusting member 50 are rotated together with the rotating body 20.

As shown in the enlarged portion of FIG. 9, when the second rotational angle adjusting member 50 is rotated, the second curved protrusion portion 56 of the second rotational angle adjusting member 50 is released from the first curved insertion portion 144 of the first rotational angle adjusting part 14 while being pushed downward and naturally passes over the first curved protrusion portion 146.

Thereafter, as shown in FIG. 10, when the rotating body 20 is further rotated, while the second rotational angle adjusting member 50 is moved upward by the elastic force of the elastic member 60, the second curved protrusion portion 56 of the second rotational angle adjusting member 50 is elastically inserted into the first curved insertion portion 144 of the first rotational angle adjusting part again.

At the same time, while the operating member 40 is rotated, the elevating plate 30 screw-coupled with the operating member 40 moves upward, and thus, the stick cosmetics 'S' attached to the upper portion of the elevating plate 30 is drawn out through the inlet 12 of the main body 10.

Thereafter, as shown in FIG. 11, makeup is applied to the skin by using the stick cosmetics 'S' drawn out of the main body 10, and the stick cosmetics 'S' are inserted into the main body 10 by rotating the rotating body 20 in reverse. Then, the overcap 70 is closed to keep or carry it.

As described above, the stick-type cosmetic container for controlling a rotational angle of a rotating body at a predetermined angle described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Main body
11: Main body through hole
12: Inlet
14: First rotational angle adjusting part
20: Rotating body
21: Rotating body through hole
22: Vertical insertion groove
30: Elevating plate
32: Plate portion
34: Screw coupling portion
40: Operating member
41: Central cylinder
42: Screw protrusion
44: Side plate
50: Second rotational angle adjusting member
52: Vertical insertion piece
54: Second curved insertion portion
56: Second curved protrusion portion
60: Elastic member
70: Overcap
80: Lower cap
90: Sealing member
144: First curved insertion portion
146: First curved protrusion portion
342: Screw groove
S: Stick cosmetics

The invention claimed is:

1. A stick-type cosmetic container for controlling a rotational angle of a rotating body at a predetermined angle, the stick-type cosmetic container comprising:

a main body formed at one side thereof with an inlet and at an opposite side thereof with a first rotational angle adjusting part;

a rotating body rotatably coupled to the main body;

an elevating plate moved up and down inside the main body, the elevating plate having one side to which stick cosmetics are attached and an opposite side at which a screw groove is formed;

an operating member coupled to an inside of the rotating body to rotate together with the rotating body, and formed with a screw protrusion coupled to the screw groove of the elevating plate;

a second rotational angle adjusting member movable up and down inside the rotating body to rotate together with the rotating body and engaged with the first rotational angle adjusting part; and an elastic member for elastically supporting the second rotational angle adjusting member, wherein, when the rotating body rotates, the second rotational angle adjusting member is repeatedly engaged at a predetermined rotational angle with the first rotational angle adjusting part while elastically moving up and down to constantly control a rotational angle of the rotating body at a predetermined angle.

2. The stick-type cosmetic container of claim 1, further comprising:

an overcap that opens and closes the main body.

3. The compact cosmetic container of claim 1, further comprising:

a lowercap coupled to the rotating body.

4. The compact cosmetic container of claim 1, wherein a rotating body through hole is formed at a center of the rotating body such that the first rotational angle adjusting part of the main body is rotatably coupled while passing through the rotating body through hole.

5. The compact cosmetic container of claim 1, wherein a rotating body through hole is formed at a center of a lower portion of the main body, and a central cylinder is formed at a center of the operating member such that the central cylinder is rotatably coupled while passing through the main body through hole from an inside of the rotating body.

6. The compact cosmetic container of claim 1, wherein a vertical insertion groove is formed in the rotating body, and a vertical insertion piece is formed in the second rotational angle adjusting member and inserted into the vertical insertion groove.

7. The compact cosmetic container of claim 1, wherein a vertical guide groove is formed in the second rotational angle adjusting member, and a vertical guide bar is formed in the operating member and inserted into the vertical guide groove.

8. The compact cosmetic container of claim 1, wherein a first curved insertion portion and a first curved protrusion portion are formed in the first rotational angle adjusting part, a second curved insertion portion and a second curved protrusion portion are formed in the second rotational angle adjusting member, and the first curved insertion portion and the first curved protrusion portion of the first rotational angle adjusting part correspond to the second curved insertion portion and the second curved protrusion portion of the second rotational angle adjusting member, respectively.

9. The compact cosmetic container of claim 8, wherein the second curved insertion portion and the second curved protrusion portion are formed in a stepped shape inside the second rotational angle adjusting member, such that lower ends of the first curved insertion portion and the first curved protrusion portion of the first rotational angle adjusting part are placed thereon.

* * * * *